US006276308B1

(12) United States Patent
Warga et al.

(10) Patent No.: US 6,276,308 B1
(45) Date of Patent: Aug. 21, 2001

(54) COOLED-DOOR BOILER

(75) Inventors: Zeljko Warga, Maribor; Jurij Skorjanc, Sentjur, both of (SI)

(73) Assignee: International Combustion Systems, Inc, Tucson, AZ (US)

( * ) Notice: Subject to any disclaimer, the term of this patent is extended or adjusted under 35 U.S.C. 154(b) by 0 days.

(21) Appl. No.: 09/552,990

(22) Filed: Apr. 21, 2000

(51) Int. Cl.[7] ..... F23M 7/04
(52) U.S. Cl. ..... 122/498; 110/180
(58) Field of Search ..... 122/497, 498–199, 122/189; 110/180

(56) References Cited

U.S. PATENT DOCUMENTS

| | | | | |
|---|---|---|---|---|
| 725,746 | * | 4/1903 | Moore | 110/180 |
| 789,550 | * | 5/1905 | Knox | 122/498 |
| 850,155 | * | 4/1907 | Hammerberg | 110/180 |
| 3,155,080 | * | 11/1964 | Braun | 122/498 |
| 3,156,218 | * | 11/1964 | Braun | 122/498 |
| 3,194,192 | * | 7/1965 | Murton | 122/498 |
| 4,570,550 | * | 2/1986 | Wilt | 122/498 |
| 5,168,818 | | 12/1992 | Joffrion . | |
| 5,611,299 | | 3/1997 | Varga et al. . | |

FOREIGN PATENT DOCUMENTS

| | | |
|---|---|---|
| 1911608 | 11/1964 | (DE) . |
| 1579940 | 12/1971 | (DE) . |
| 4016880 | 11/1991 | (DE) . |

* cited by examiner

*Primary Examiner*—Gregory Wilson
(74) *Attorney, Agent, or Firm*—Jennings, Strouss & Salmon PLC; Joseph W. Mott

(57) ABSTRACT

An improved boiler of the warm water or steam type includes a door with a water chamber to assist in cooling the boiler. Water moves from the boiler to the door chamber through a bottom pipe on the connected vessels principle. Water or steam exit the door through a top pipe and return to the boiler. In a warm water boiler, a circulating pump in the upper pipe maintains water flow through the door.

10 Claims, 4 Drawing Sheets

COOLED-DOOR BOILER

BACKGROUND OF THE INVENTION

The invention relates to a boiler having a fire chamber which is cooled by water, and a door which is likewise cooled by water, in which an opening for an oil or gas burner is located. A boiler possessing these features is described in DE 40 16 880 A1. Here the entire fire chamber is cooled by water circulating in an annular wall surrounding the cylinder of the chamber and in the front door and rear face wall.

A warm-water boiler having a fire chamber rinsed by water is described in DE-AS 1 579 940. This boiler includes a hollow rotating body whose diameter increases toward the end of the fire chamber where the door is located. A diffuser-type configuration of the cooling device is achieved, with the additional advantage of reducing noise by attaining a laminar flow of the heating gases. The heating surfaces of this boiler are also intended to be acted upon uniformly by the fuel gases, increasing the efficiency of the boiler. A steam boiler whose one face will have a double-cone-shaped insert, and whose double wall has boiler water flowing therethrough, is described in DE-U-1 911 608. In this design, the cross-section of the insert tapers toward the interior of the boiler, making it inappropriate for oil or gas fired boilers.

U.S. Pat. No. 5,611,299 discloses a water-cooled boiler door with water pumped in and out of the top portion of the door. Such a configuration works for hot water boilers, but not for steam boilers because it does not provide an exit path for the steam.

U.S. Pat. No. 5,168,818 discloses a liquid cooled boiler door in which liquid enters the bottom of the door and flows out through the top. This door is designed to function as a water cooled turnaround chamber in a dryback Scotch Marine type boiler, and cannot accommodate attachment of a burner to the inside of the door. Moreover, the hemispherical shape needed for effective functioning of the disclosed door adds substantially to the overall length, and when opened also to the width of the boiler, which is undesirable in most boiler applications.

SUMMARY OF THE INVENTION

The object of the invention is to propose a simple design of a cooled door boiler applicable to fire tube and water tube steam and hot water configurations such as those described above. In accordance with the invention, sets of pipes below and above the boiler housing and door deliver water from the exterior housing of the boiler to the door and bring away the steam generated in the door. The water enters and leaves the door on the connected vessels principle, simplifying the structure. Mounting for a burner is located in the door, and a partition prevents the hot burner gas from contact with the part of the door not containing water. Cooling the door increases the cooled area in the boiler fire chamber and reduces the exterior temperature of the door. This contributes to increased heat transfer in the boiler and reduced heat losses, thereby improving boiler efficiency. Maintenance costs are reduced because refractory material is not needed in the door.

DETAILED DESCRIPTION OF THE INVENTION

Figure 1:
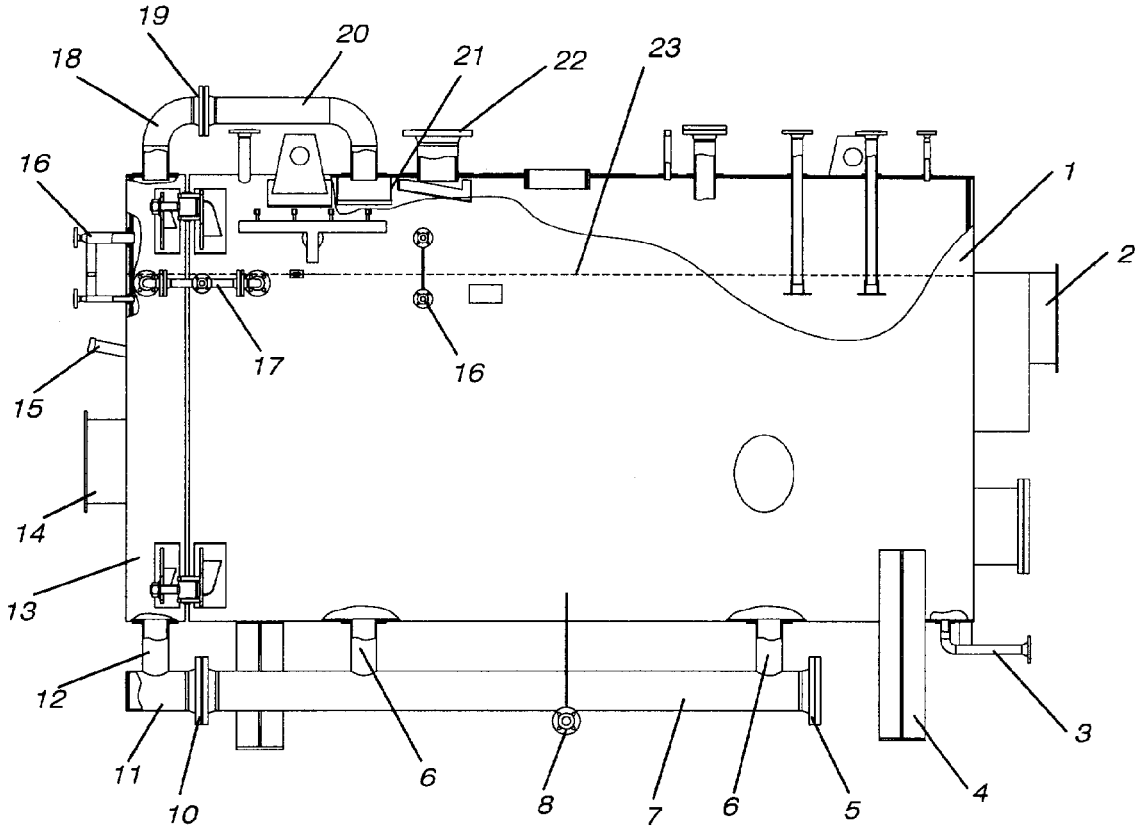
FIG. 1 is a side view of a fire-tube steam boiler with a cooled door wrapped in a thermally insulated jacket.
Figure 2:
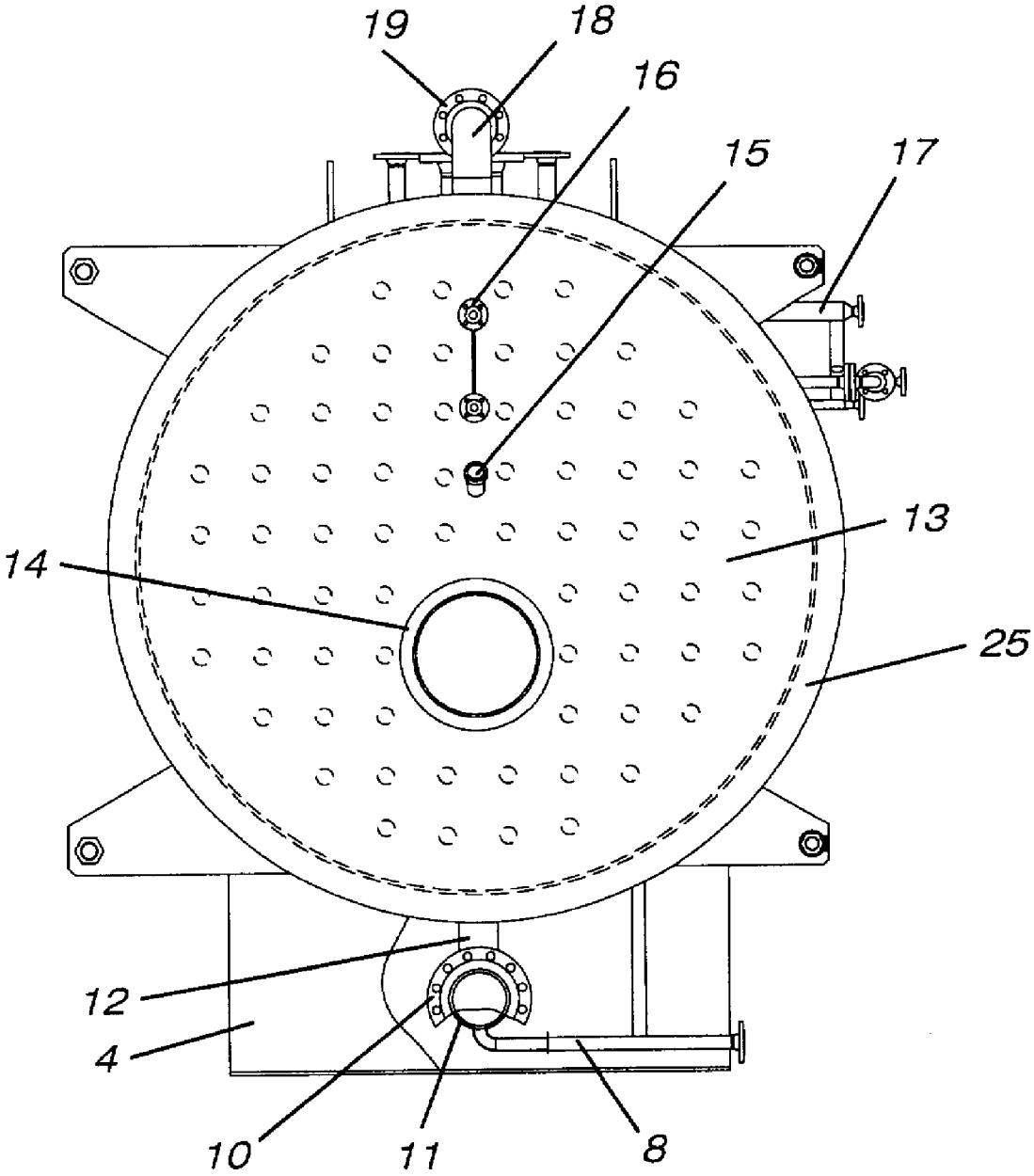
FIG. 2 is a front view of a boiler door with the insulated jacket removed.
Figure 3:
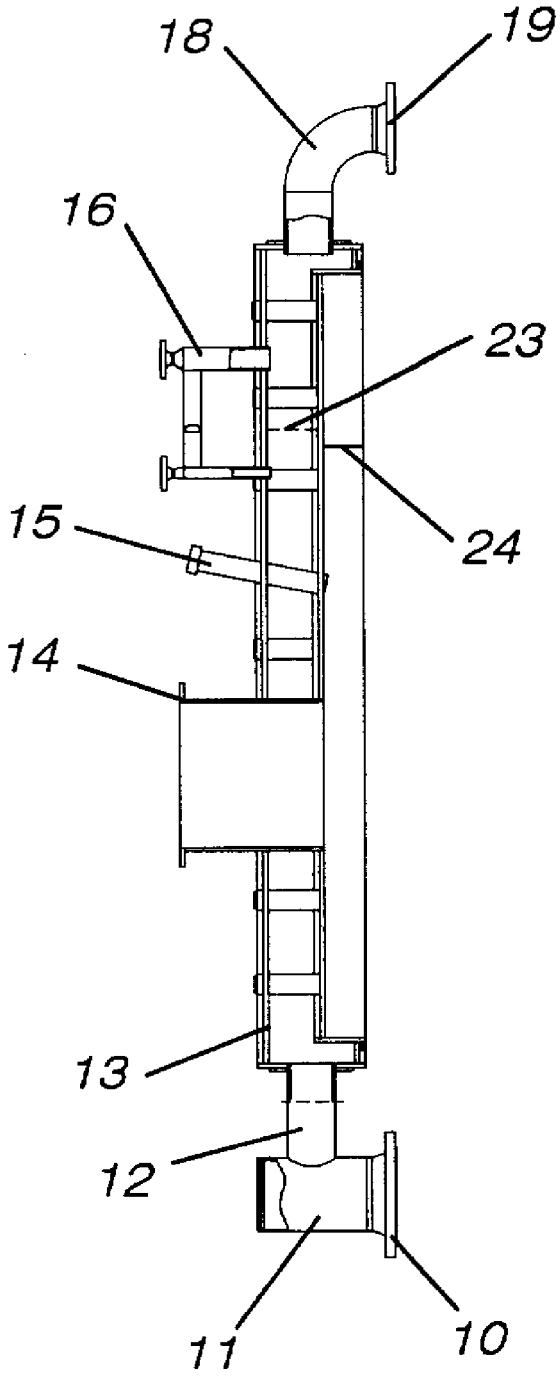
FIG. 3 is a side view of the door of FIG. 2.

The boiler of FIG. 1 is suitable for operation with both gaseous and liquid fuels. Boiler 1 is placed on legs 4. Water line 23 is the same level in boiler 1 and the water chamber in door 13. Steam forms in the space above the water line in the door and the boiler.

Both the door 13 and the boiler 1 are clad in a thermally insulated jacket 25. The flame in the boiler is observed through aperture 15 in the door, and the burner is attached to door 13 on burner mounting plate 14. Water level gauges 16 are located on boiler 1 and door 13.

Flue gas exits the boiler 1 through outlet 2 in the rear of the boiler. Inside boiler 1, adjacent door 13, the flue gas is diverted into a tube assembly (not shown) as in standard boiler design for transmission to outlet 2. Partition 24, made of fire resistant steel, prevents the hot flue gas from entering the area above water line 23 so that the flue gas is always in an area cooled by the boiler water or the water in the door. Allowing hot flue gas to flow alongside the inner wall of the door above the water line could damage the door, because the steam in the door chamber above the water line cannot carry away the heat as well as water can.

A portion of the water in the boiler flows from the bottom of boiler 1 into door 13 through bottom pipes 6, longitudinal pipe 7, connection pipe 11 and upflow pipe 12. Flow is achieved on the connected vessels principle. Longitudinal pipe 7 carries water from several locations in the bottom of the boiler, and additionally can collect sediment falling through bottom pipes 6.

The water in door 13 is transformed by heat into steam above water line 23, and exits the door through pipes 18 and 20, thereby returning to the boiler. As known in the art, these pipes can be sized for the flow and pressure to prevent whistling during operation. Flow dispeller 21, attached to pipe 20, directs the incoming steam so that it remains above the water line. This prevents the door steam from getting wet and allows it to exit with the boiler steam through steam outlet 22.

Flanges 10 and 19 in the flow pipes allow the door to be opened, and permit emptying and cleanout of the door chamber. Flange 5 in pipe 7 permits removal of sediment deposits that have fallen through pipes 6 accumulated below the boiler. Connection 3 and 8 on the underside of boiler 1 allow draining of the boiler water and removal of sediment deposits directly from the bottom of the boiler. Pipes 17 remove solids from the water surface on an ongoing basis during operation.

Figure 4:
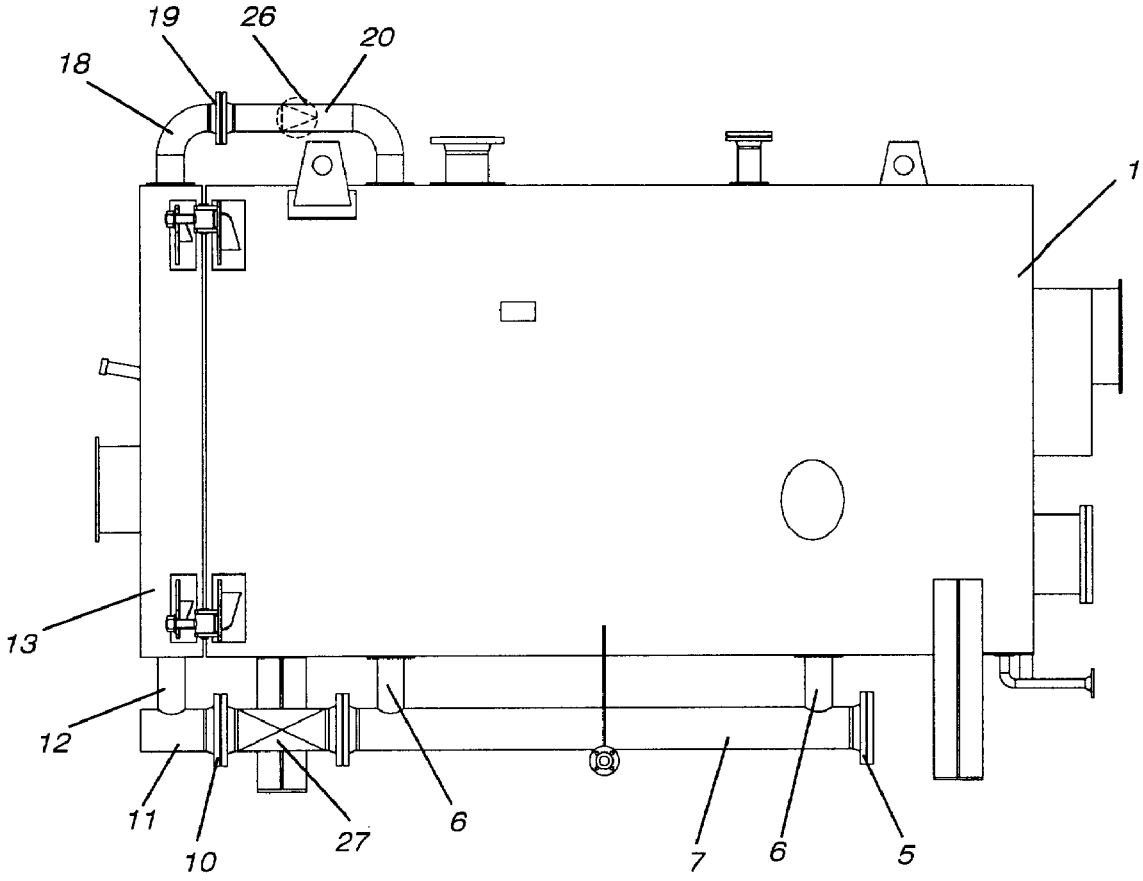
FIG. 4 is a boiler configured for hot water operation.

Door cooling in accordance with the present invention may also work in connection with a hot water boiler, as shown in FIG. 4. In a hot water boiler, the entire system is filled with water and there is no steam chamber in the boiler or the door. Pump 26 is added to door outlet pipe 20 to cause water to flow through the door and back into the boiler. In this configuration, partition 24 is not needed. Valve 27 in this embodiment, which permits opening of the door without having to drain the entire boiler of water, can be used with other embodiments as well.

By cooling the door in accordance with the present invention, the cooled area in boiler 1 is enlarged without changing the dimensions of the boiler. Moreover, heat losses to the environment through the door are reduced because the outside temperature of the door is limited to the temperature of the boiler water and emitted steam. Cooling the door also eliminates the need for refractory material on the door. As a consequence, the boiler is more efficient and easier to maintain.

Numerous alterations and modifications of the structure herein disclosed will suggest themselves to those skilled in the art. It is to be understood, however, that the present disclosure relates to the preferred embodiment of the invention which is for the purpose of illustration only and not to be construed as a limitation of the invention. All such modifications which do not depart from the spirit of the invention are intended to be included within the scope of the appended claims.

We claim:

1. An oil or gas burning steam boiler, comprising: an exterior housing; a water cooled fire chamber within said exterior housing; a door having (i) a water chamber on said exterior housing, forming a front face wall of said fire chamber when closed, said water chamber having a water line above which is formed a steam chamber; and (ii) a burner mounting plate for attachment of a burner inside the boiler to generate hot gas; a fire-resistant partition in the fire chamber above the burner, placed below the water line of the door water chamber so as to prevent hot gas from flowing adjacent to a portion of the door not containing water; said door being cooled by water entering the water chamber through at least one pipe connecting a bottom portion of the boiler with a bottom portion of the door; said boiler including at least one pipe connecting a top portion of the door with a top portion of the boiler.

2. The boiler of claim 1 further including a flow dispeller attached to the pipe at the top of the boiler to direct any steam generated by heating the water in the door to flow into an area above the water in the boiler.

3. The boiler of claim 1 further including a plurality of flanges in the pipes connecting the door to the boiler so that the door may be opened.

4. The boiler of claim 1 further including a valve in the pipe connecting the bottom portion of the boiler with the bottom portion of the door.

5. The boiler of claim 1 further including a longitudinal pipe attached below the exterior housing connected to a plurality of bottom pipes allowing boiler water to pass from the bottom of the boiler to the longitudinal pipe and to a connecting pipe to the water cooled door.

6. The boiler of claim 5 further including a flange at the end of the longitudinal pipe for emptying and cleaning the pipe.

7. An oil or gas burning warm water boiler, comprising: an exterior housing; a water cooled fire chamber within said exterior housing; a door having a water chamber on said exterior housing, forming a front face wall of said fire chamber when closed; said door having a burner mounting plate for attachment of a burner inside the boiler; said door being cooled by water entering the water chamber through at least one pipe connecting a bottom portion of the boiler via a longitudinal pipe attached below the exterior housing with a bottom portion of the door; said boiler further including at least one pipe connecting a top portion of the door with a top portion of the boiler; and a circulating pump located in a pipe connecting the top portion of the door with the top portion of the boiler.

8. The boiler of claim 7 further including a plurality of flanges in the pipes connecting the door to the boiler so that the door may be opened.

9. The boiler of claim 7 further including a valve in the pipe connecting the bottom portion of the boiler with the bottom portion of the door.

10. The boiler of claim 7 further including a flange at the end of the longitudinal pipe for emptying and cleaning the pipe.

* * * * *